US005727516A

United States Patent [19]

Augustin et al.

[11] Patent Number: 5,727,516

[45] Date of Patent: Mar. 17, 1998

[54] METHOD OF CONTROLLING AN INTERNAL COMBUSTION ENGINE UPON DETECTION OF A FAULT INN A FUEL INJECTION SYSTEM

[75] Inventors: Ulrich Augustin, Kernen; Volker Schwarz, Weinstadt, both of Germany

[73] Assignee: Mercedes - Benz AG, Stuttout, Germany

[21] Appl. No.: 823,381

[22] Filed: Mar. 24, 1997

[30] Foreign Application Priority Data

Apr. 2, 1996 [DE] Germany ..... 196 13 184.7

[51] Int. Cl.[6] ..... F02M 37/04

[52] U.S. Cl. ..... 123/198 DB; 123/456; 123/447

[58] Field of Search ..... 123/456, 497, 123/198 DB, 198 D, 479, 516, 514, 510, 447

[56] References Cited

U.S. PATENT DOCUMENTS

| | | | |
|---|---|---|---|
| 4,539,959 | 9/1985 | Williams | 123/456 |
| 4,565,170 | 1/1986 | Grieshaber | 123/198 DB |
| 4,957,084 | 9/1990 | Kramer | 123/198 DB |
| 5,074,272 | 12/1991 | Bostick | 123/516 |
| 5,241,933 | 9/1993 | Morikawa . | |
| 5,275,143 | 1/1994 | Lembke | 123/479 |
| 5,417,194 | 5/1995 | Augustin | 123/479 |
| 5,441,026 | 8/1995 | Akimoto | 123/198 DB |
| 5,551,390 | 9/1996 | Tsuge | 123/198 DB |

FOREIGN PATENT DOCUMENTS

| | | |
|---|---|---|
| 0 501 459 | 2/1992 | European Pat. Off. . |
| 43 35 171 | 5/1995 | Germany . |
| WO 95/06814 | 3/1995 | WIPO . |

*Primary Examiner*—Carl S. Miller
*Attorney, Agent, or Firm*—Klaus J. Bach

[57] ABSTRACT

In a method of controlling the operation of an internal combustion engine with fuel injection by way of a common high pressure (common rail) fuel supply line to which high pressure fuel is supplied by a high pressure fuel pump and from which fuel is admitted to the various cylinders of the internal combustion engine by valve controlled fuel injection nozzles, the fuel pressure in the common fuel supply line between the end of an injection and the start of a fuel supply period is monitored at distinct timely spaced measurement points and, if a pressure difference between the measurement points is sensed in excess of a predetermined limit value indicating an injector malfunction, the high pressure fuel supply to the common fuel supply line is interrupted by deactivating the high pressure fuel pump while fuel injection through the operative nozzles is maintained so as to rapidly reduce the pressure in the common fuel supply line.

2 Claims, 2 Drawing Sheets

METHOD OF CONTROLLING AN INTERNAL COMBUSTION ENGINE UPON DETECTION OF A FAULT INN A FUEL INJECTION SYSTEM

BACKGROUND OF THE INVENTION

The invention relates to a method of controlling an internal combustion engine upon detection of faulty operation of a fuel injection system which is associated with the engine and which is supplied with fuel by a high-pressure pump feeding fuel into a common supply line (common rail) from where the fuel is distributed to the fuel injection nozzles of the various cylinders of an internal combustion engine.

Such a method is known from EP 0 501 459 B1, in which operational errors in the injection system can be sensed, especially faulty high-pressure pumps can be identified.

The injection system which comprises components, such as a high-pressure pump, common supply line, fuel injection nozzles, a non-return valve and injection lines, is continuously subjected to the high fuel pressure generated by the high-pressure pump. Operational faults (errors) resulting for example from leaks in these components would result in a severe loss of fuel. The high fuel pressure in the supply line can then no longer be maintained. The consequence is improper fuel injection and thus a degradation of the operation of the internal combustion engine. If this operational fault is not detected promptly the entire system may soon fail.

Operational problems may also occur as a result of faulty nozzles, for example by sticking nozzle needles or clogged nozzles which, consequently, no longer operate satisfactorily. If the nozzle needle is stuck open, the internal combustion engine would be at a high risk to be severely damaged during subsequent combustions because of an excessively large fuel injection quantity particularly since the ignition point could no longer be controlled.

It is therefore the principal object of the present invention to provide simple measures which intervene in the fuel injection system in such a way that damage to the engine can be avoided when a fuel injection nozzle is no longer operating satisfactorily.

SUMMARY OF THE INVENTION

In a method of controlling the operation of an internal combustion engine with fuel injection by way of a common high pressure (common rail) fuel supply line to which high pressure fuel is supplied by a high pressure fuel pump and from which fuel is distributed to the various cylinders of the internal combustion engine by valve controlled fuel injection nozzles, the fuel pressure in the common fuel supply line between the end of an injection and the start of a fuel supply period is monitored at distinct timely spaced measurement points and if a pressure difference between the measurement points is sensed in excess of a predetermined limit value indicating an injector malfunction, the high pressure fuel supply to the common fuel supply line is interrupted by deactivating the high pressure fuel pump while fuel injection through the operative nozzles is maintained so as to rapidly reduce the pressure in the common fuel supply line.

With these method steps, damage to the internal combustion engine or even its destruction can be prevented if the faulty operation of the fuel injection system is caused by a defect in a fuel injection nozzle. When it has been determined that a nozzle needle is stuck in the open position, the high pressure present in the common fuel supply line is quickly reduced by interrupting the high pressure fuel supply while simultaneously maintaining the normal injection pressure at the properly operating nozzles.

In this way, a destruction of the engine as a result of a faulty nozzle can be avoided.

Since the quantity of fuel stored in the common fuel supply line is only a small multiple of the injection quantities of all the nozzles during a cycle, one or two cycles or one or two camshaft revolutions are sufficient for reducing the pressure in the common fuel supply line.

In order to accelerate the reduction in pressure, the injection quantities for the properly operating nozzles may be increased simultaneously with the deactivation of the high-pressure pump.

The invention is described below in greater detail on the basis of the accompanying drawings.

DESCRIPTION OF A PREFERRED EMBODIMENT

Figure 1:
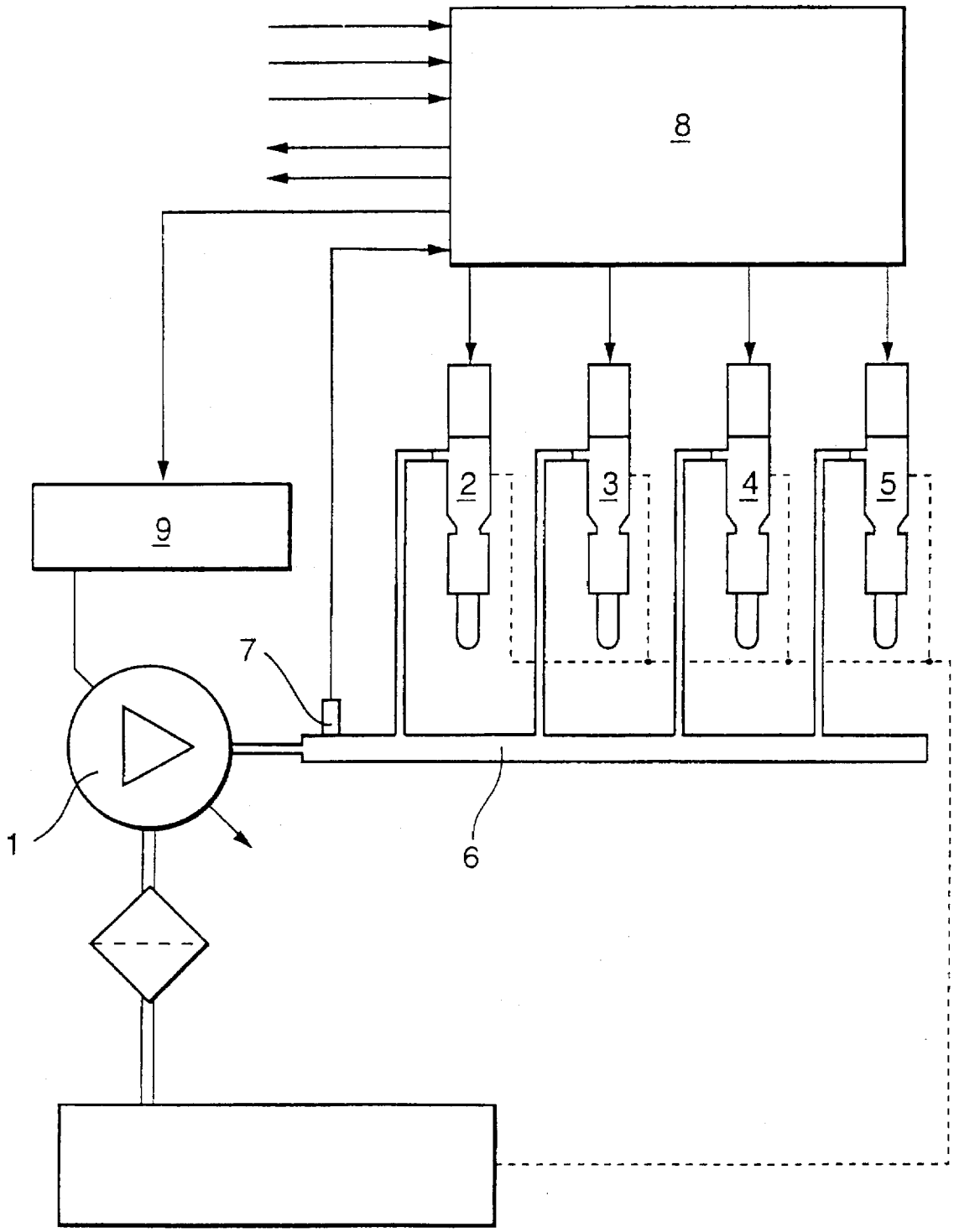
FIG. 1 shows a fuel injection system with a common supply line serving as a high-pressure accumulator for all the solenoid valve-controlled nozzles.

As shown in FIG. 1, a fuel injection system for multi-cylinder internal combustion engines comprises a demand-controlled high pressure pump 1 which feeds fuel into a common supply line 6, which is provided for all the solenoid valve controlled nozzles 2, 3, 4, 5, and which serves as a high pressure fuel accumulator.

The supply line 6 includes a high-pressure sensor 7 which senses the actual fuel pressure. In he event of deviations from the desired pressure value which should be in a predetermined operating range, the high pressure is adjusted by an electronic control unit 8 specifically by way of a pressure regulator 9 which interacts with the high pressure pump 1. The control unit 8 operates in response to operating parameters, that is, depending on various measurement variables indicating internal combustion engine and vehicle operating conditions.

The high-pressure sensor 7 mounted on the supply line 6 is not only responsible for maintaining a specific pressure level but is, at the same time, used to detect incorrectly operating fuel injection nozzles.

Figure 2:
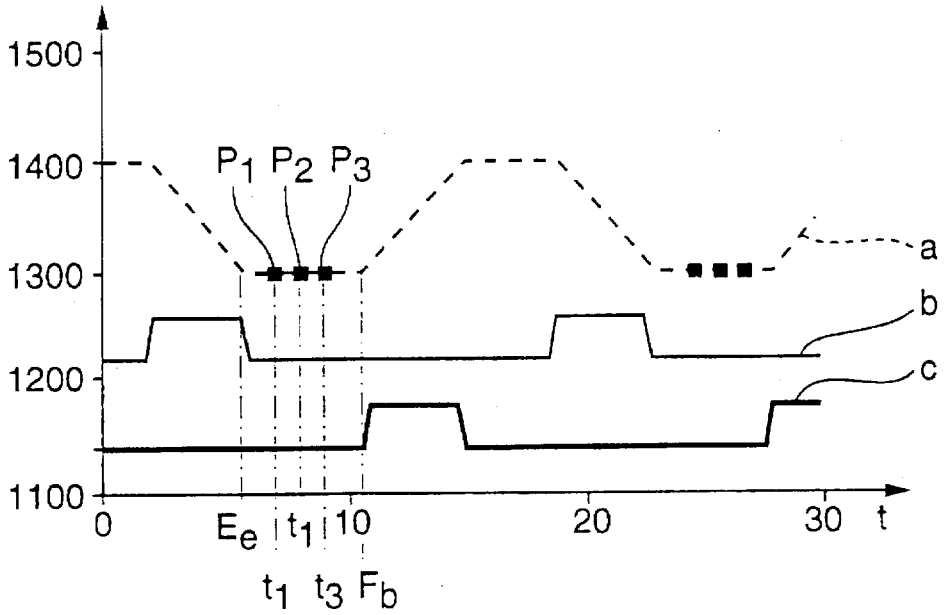
FIG. 2 is a graphic illustration of the synchronous character of the fuel pressure in the fuel pressure supply line during the supply of the fuel and the injection of the fuel with fault-free operation of the fuel injection system.

FIG. 2 shows a diagram with phase-synchronous characteristic pressure curves a, b and c for the fuel under high pressure (rail pressure) for feeding the fuel to, and injecting the fuel through the injectors 3. The pressure curve shows three distinct pressure measurement points $P_1$, $P_2$, $P_3$ between the end $E_e$ of a fuel injection period and the start $F_b$ of a fuel input period. The pressure measurement points $P_1$, $P_2$, $P_3$ are registered by the high-pressure sensor 7 as shown on the time axis t at the times $t_1$, $t_2$, $t_3$.

The characteristic values as shown in FIG. 2 are obtained with fuel injection nozzles which are operating free of faults.

Figure 3:
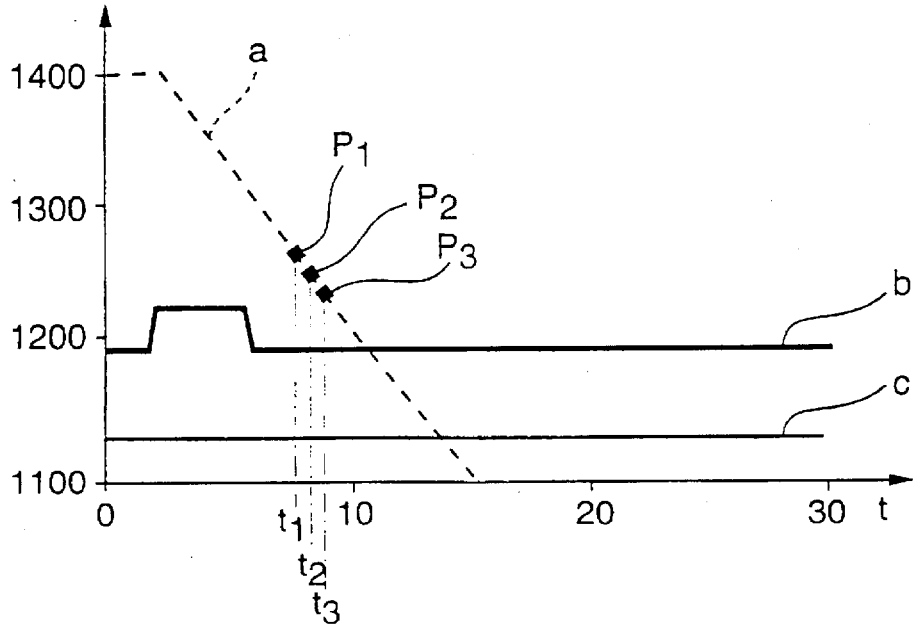
FIG. 3 is a graphic illustration of the synchronous character of the fuel pressure in the fuel supply line during the supply of fuel and the injection of the fuel with faulty operation of the fuel injection system.

Once an operational fault occurs at one of the three nozzles 2, 3, 4, 5, for example because a nozzle needle does not close as a result of jamming, a declining high-pressure curve as shown in FIG. 3, is obtained.

The high-pressure sensor 7 detects this unusual drop in pressure and then indicates this drop in pressure as a fault if the detected pressure differences exceed a predetermined limit value. In this case, the high-pressure pump 1 is deactivated and all of the properly operating nozzles 2, 3, 4, 5 continue to be supplied with fuel for subsequent fuel injections, so that, as a result of the interruption of the high-pressure supply on the one hand and further injection on the other, the pressure in the common supply line 6 is rapidly reduced.

However, the drop in pressure can, if necessary, also be accelerated if, with the deactivation of the high-pressure pump 1, the fuel injection quantities for the properly operating nozzles are simultaneously increased by keeping the nozzle needles of the solenoid valves open for a longer time.

In this way, the engine is rapidly shut down without damage to the internal combustion engine. This is quite important since, in the worst case, such faulty fuel injection could lead to a complete destruction of the engine.

What is claimed is:

1. A method of controlling the operation of an internal combustion engine upon detection of a faulty operation of a fuel injection system which is associated with the engine and which is supplied with fuel by a high pressure pump feeding fuel into a common fuel supply line from where fuel is distributed to the engine cylinders under the control of fuel solenoid valve-actuated injection nozzles mounted on the cylinders of the internal combustion engine, said method comprising the steps of:

sensing the fuel pressure in said common fuel supply line at distinct, timely-spaced points in the normally constant pressure period between the end of an injection and the start of a fuel supply period in which the pressure in said common fuel supply line increases, interrupting the high pressure fuel supply to said common fuel supply line by deactivating said high pressure fuel pump if a pressure difference between said measurement points in excess of a predetermined limit value is sensed which is indicative of a fuel injection nozzle failure and continuing injection through the operative fuel injection nozzles so as to rapidly reduce the fuel pressure in said common fuel supply line.

2. A method according to claim 1, wherein, during said continued fuel injections, increased fuel quantities are injected through said operative injectors irrespective of the load state of the internal combustion engine.

* * * * *